US005737832A

United States Patent [19]

Bubb

[11] Patent Number: 5,737,832

[45] Date of Patent: Apr. 14, 1998

[54] IN AND RELATING TO MACHINES FOR FORMING HELICALLY WOUND LOCK-SEAM TUBING HAVING MULTIPLE WALL THICKNESS

[75] Inventor: Antony John Bubb, West Clandon, England

[73] Assignee: Protol A.G., Glarus, Switzerland

[21] Appl. No.: 685,776

[22] PCT Filed: Oct. 4, 1993

[86] PCT No.: PCT/GB93/02057

§ 371 Date: Jun. 3, 1994

§ 102(e) Date: Jun. 3, 1994

[87] PCT Pub. No.: WO94/07620

PCT Pub. Date: Apr. 14, 1994

Related U.S. Application Data

[63] Continuation of Ser. No. 244,586, Jun. 3, 1994, abandoned.

[30] Foreign Application Priority Data

Oct. 7, 1992 [GB] United Kingdom ..... 9221093

[51] Int. Cl.[6] ..... B23P 21/00; B21C 37/12

[52] U.S. Cl. ..... 29/781; 72/49

[58] Field of Search ..... 29/464, 779, 781, 29/782, 819, 429; 72/49, 50; 226/17, 181, 182, 183; 228/17.7, 145; 492/22, 28, 30

[56] References Cited

U.S. PATENT DOCUMENTS

| | | | |
|---|---|---|---|
| 1,580,760 | 4/1926 | Palmer . | |
| 2,530,282 | 11/1950 | Brodie et al. | 492/30 X |
| 3,004,324 | 10/1961 | Macomber | 29/429 X |
| 3,219,246 | 11/1965 | Kihara | 226/181 |
| 3,263,321 | 8/1966 | Lombardi . | |
| 3,422,525 | 1/1969 | Jeppsson | 29/781 X |
| 3,487,537 | 1/1970 | Lombardi . | |
| 3,661,314 | 5/1972 | Tselikov et al. . | |
| 3,755,873 | 9/1973 | Lansing | 29/779 X |
| 3,893,662 | 7/1975 | Boyd | 226/17 X |
| 3,918,626 | 11/1975 | McLain . | |
| 4,160,312 | 7/1979 | Nyssen . | |
| 4,286,860 | 9/1981 | Gursky et al. | 226/181 X |
| 4,746,049 | 5/1988 | Oe et al. | 228/17.7 |
| 5,222,288 | 6/1993 | Thomas . | |

FOREIGN PATENT DOCUMENTS

| | | | |
|---|---|---|---|
| 0353622 | 2/1990 | European Pat. Off. . | |
| 2032737 | 11/1970 | France . | |
| 2107500 | 5/1972 | France . | |
| 2745389 | 1/1979 | Germany . | |
| 1371726 | 2/1988 | Russian Federation | 492/28 |
| 0110576 | 1/1917 | United Kingdom . | |
| 0326102 | 3/1930 | United Kingdom . | |
| 1431222 | 4/1976 | United Kingdom . | |
| 1435264 | 5/1976 | United Kingdom . | |

*Primary Examiner*—Joseph M. Gorski
*Attorney, Agent, or Firm*—Martin Smolowitz

[57] ABSTRACT

This invention pertains to a machine for forming helical lock-seam tubing. The machine includes rollers for forming flanges on edges of laterally staggered overlapped strips, a forming head for forming the strips into a helical configuration, rollers for clinching the flanges into locking engagement, reels for supplying the strips, and structure for guiding the strips from the reels to the forming rollers.

7 Claims, 4 Drawing Sheets

IN AND RELATING TO MACHINES FOR FORMING HELICALLY WOUND LOCK-SEAM TUBING HAVING MULTIPLE WALL THICKNESS

This application is a continuation of application Ser. No. 08/244,586, filed Jun. 3, 1994 and now abandoned.

BACKGROUND OF THE INVENTION

This invention concerns improvements in machines for the formation of helical lock-seam tubing, and relates more especially to such a machine adapted for the production of such tubing having a multiple wall thickness.

It has hitherto been proposed, see FR-A-2,032,737 and FR-A-2,107,500, to provide helical lock-seam tubing having a multiple wall thickness. Hitherto, however, the production of a machine capable of forming such tubing has proposed practical difficulties.

It is accordingly an object of the invention to provide such a machine.

SUMMARY OF THE INVENTION

In accordance with the invention there is provided a machine for the formation of helical lock-seam tubing, characterized in that it comprises means for guiding at least two superposed metal strips in overlapping relationship successively between a series of forming rollers wherein flanges are formed upon the opposite marginal edges of the superposed strips, whilst overlapped upon one another, a pair of drive rollers for causing the superposed strips to be drawn through the forming rollers and then advanced towards a helical forming head, and clinching rollers associated with the helical forming head such that the flanges formed at the respective marginal edges of the overlapped metal strips are clinched into locking engagement with one another to provide a helical locked-seam, consecutive helices of which are spaced apart by a distance corresponding to the width of the overlapped metal strips.

Various further optional features may be incorporated in the machine, in accordance with the invention, in order further to improve the effective handling of the overlapped strips.

Thus, according to one aspect of the invention guide rollers between which the overlapped metal strips are fed to said forming rollers are provided with radially stepped shoulders so arranged that the strips passing between the rollers are held with their widths in a staggered relationship to one another, the distance of lateral displacement being so selected that relative displacement of the edges of the strips during forming of said flanges and clinching of said lock-seam brings the lateral edges of the respective strips to lie in a substantially common plane. The shoulders of the guide rollers may be adapted to provide for the location of two overlapping strips or three, or possibly more overlapping strips.

According to another aspect of the invention, the drive roller that is arranged for gripping engagement with the exposed surface of that one of the overlapping strips that is to be at the exterior surface of the finished tubing has a knurled or patterned surface. Thus the arrangement of drive rollers is the reverse of that which is utilized in the conventional machine for forming lock-seam tubing.

In accordance with a yet further aspect of the invention, there are provided at the entry to the helical forming head of the machine, one or more shaped counter-pressure plates including portions shaped to the radius of curvature of the internal surface of the finished tubing, whereby the overlapping metal strips are held closely in contact with one another during initial bending to the radius of curvature of the helical forming head.

In order to feed helically coiled strips from supply reels, in overlapping relationship, to the rollers and the forming head of the machine, independent supply reels carrying the respective strips may be arranged one behind the other in the direction of advance of the strip towards the machine, in such a manner that the strip fed from the reel more remote from the machine is brought into contact with the next adjacent strip substantially at a point where the path of the first strip becomes tangential to a radius of the reel feeding the next adjacent strip.

In an arrangement where three individual strips are to be fed to the said guide rollers of the machine from corresponding supply reels, preferably there is interposed between that supply reel nearest to the machine and said guide rollers, a guide arrangement for maintaining the respective strips in spaced relation, such that the central strip is maintained substantially coinciding with a guide path tangential to both said rollers, the remaining strips being fed along paths extending substantially symmetrically to the plane of the intermediate strip. Further preferred features and advantages of the arrangement according to the invention will become apparent from the following description and the accompanying drawings.

BRIEF DESCRIPTION OF THE DRAWINGS

The invention is illustrated by way of example in the accompanying drawings in which.

DETAILED DESCRIPTION

Figure 1:
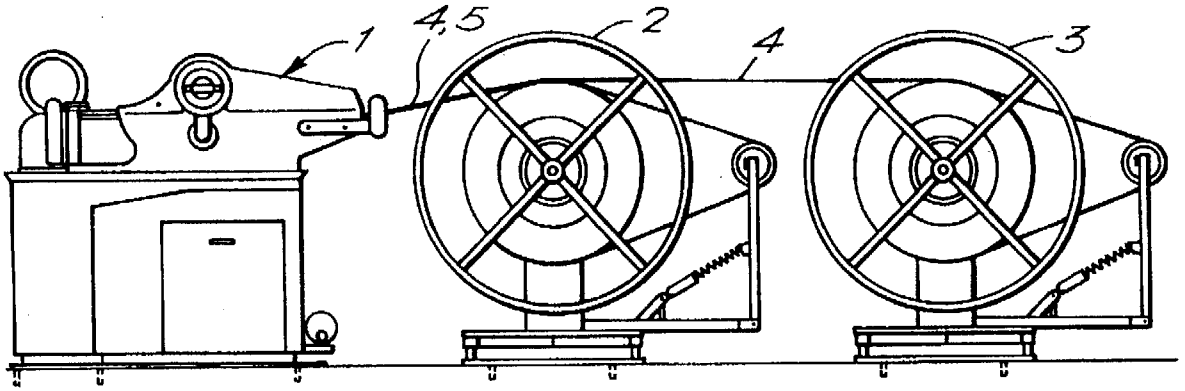
FIG. 1 is a side elevation showing the general arrangement of a machine in accordance with the invention for the formation of helically wound lock-seam tubing of double wall thickness.

Referring to FIG. 1 of the drawings, there is shown a general arrangement of one embodiment of apparatus in accordance with the invention. The reference numeral 1 illustrates a machine for the formation of helically wound lock-seam tubing, which is of generally known type, although various modifications to the known machine will be described in more detail below. Arranged in tandem with the machine 1 are two supply reels 2 and 3 that supply metal strip to the machine 1 from storage rolls. Thus, a metal strip 4 supplied from the reel 3 is first fed into contact with the roll of metal strip stored on reel 2, and, thereafter, the two overlapped metal strips 4 and 5 are fed to the machine 1. As will be described in more detail below, the strips 4 and 5 are not fully in register with one another, but are slightly staggered in the lateral direction.

Figure 2:
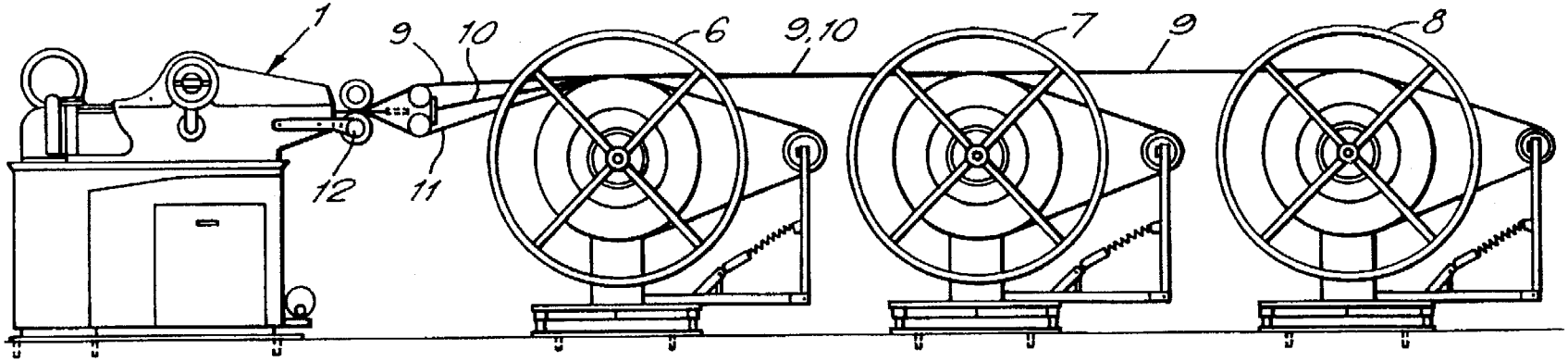
FIG. 2 is a similar view of a machine for the formation of tubing having a three layer wall thickness.

FIG. 2 shows a similar arrangement wherein strips are fed from three supply reels 6,7,8, a strip 9 from the reel 8 being advanced into contact with a strip 10 from reel 7 and then the strips 9 and 10 being advanced into contact with a further strip 11 fed from reel 6. At a point between reel 6 and the machine 1, the three strips 9,10 and 11 are separated by a guide arrangement 12 described in more detail below, so that the three strips approach the horizontal guide path of the machine 1 in a symmetrical arrangement.

As will be described in more detail below the three strips 9, 10 and 11 may comprise either three metal strips, or two metal strips with an intervening layer of insulating material.

Figure 3:
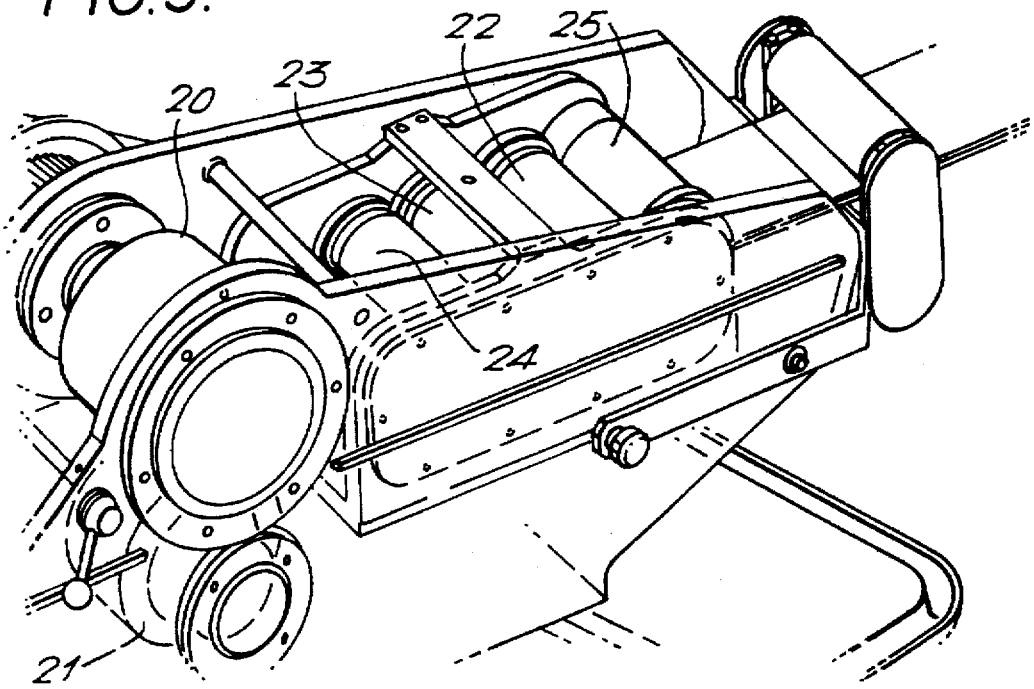
FIG. 3 is a side perspective view illustrating the arrangement of guide rollers, forming rollers, and drive rollers of a machine according to FIG. 1 of the drawings.

As already mentioned above, the machine 1 is of generally known type, but incorporates a number of modifications specifically to enable the formation in this type of machine of a conventional lock-seam at the marginal edges of a plurality of overlapping strips. As indicated in FIG. 3, the portion of the machine concerned with drawing of the metal strips from the supply reels and subsequent driving of these strips towards a helical forming head comprises, in generally known manner, a pair of nip rollers 20, 21 that are driven from a main motor of the machine, not illustrated, and that pull the metal strips between a series of three forming rollers 22, 23, 24, before pushing the overlapping strips into a helical forming head at which flanged edges of the strips are brought into engagement with one another and clinched together. The lower roller 21 has a knurled surface for engaging and gripping the surface of the corresponding metal strip.

The three forming rollers 22, 23 and 24 are of generally known type, but are of modified dimension to take account of the fact that the machine is dealing with multiple strips. Thus, assuming that the machine of FIG. 3 corresponds to that of FIG. 1 and is forming a tube of double layer thickness from a strip that is of a given lateral width at the time when it reaches the forming head, the forming roller 24 will be of standard axial length corresponding to the width of the strip moving to the forming head. However, the forming roller 23 will have its axial length increased for example by 0.75 × the thickness of each metal strip, whereas the forming roller 22 will have its axial length increased by 1.5 × the thickness of each metal strip.

In addition, the machine is provided with a pair of guide rollers 25 that maintain the overlapping metal strips in laterally staggered relationship as they are advanced to the forming rollers 22 to 24.

Figure 4B:
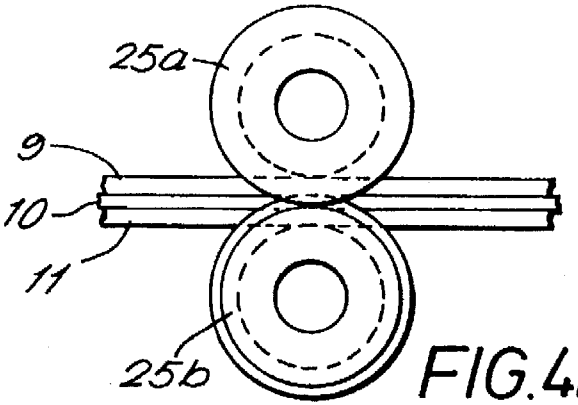
FIGS. 4*a* and 4*b* are respectively, a transverse cross-sectional view and a side view of guide rollers for use in the formation of lock-seam tubing having two overlapping metal walls with an intermediate layer of insulation.
Figure 4A:
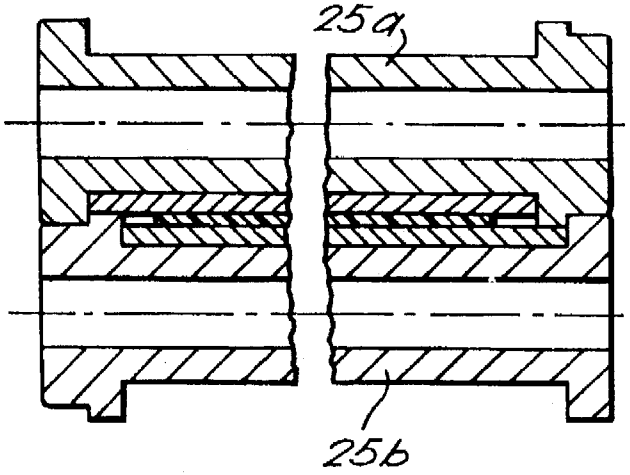

Thus, as shown in FIGS. 4*a* and 4*b*, the upper and lower guide rollers 25*a* and 25*b* have staggered recesses defined by end flanges of the rollers, that hold the metal strips in laterally staggered relationship. In FIGS. 4*a* and 4*b* the rollers are shown as being adapted for the case wherein a strip of insulating material 10 is interposed between two metal strips 9 and 11 as illustrated in FIG. 3, but the arrangement will be substantially identical if the insulating strip is omitted, the radial depths of the recesses in the rollers 25*a* and 25*b* simply being reduced by half the thickness of the insulating strip 10.

Figure 5B:
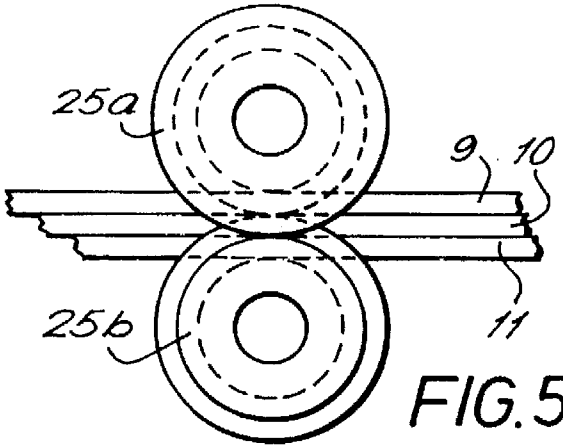
FIGS. 5*a* and 5*b* are similar views of guide rollers for three overlapping metal strips.
Figure 5A:
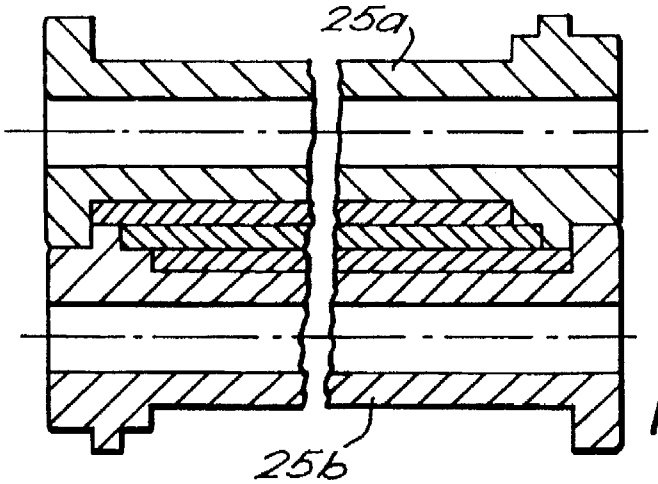

FIGS. 5*a* and 5*b* show a similar arrangement of the rollers 25 adapted to feed three overlapping metal strips to the forming rollers, and in this case it will be seen that the lateral displacement of the upper and lower strips 9 and 11 is greater than in the case of FIGS. 4 and 4*b*, due to the greater thickness of the overlapping strips that are to have flanges formed thereon by the forming rollers. The difference between the axial lengths of the respective forming rollers 22, 23 and 24 will of course be correspondingly greater. It will be appreciated that since all three overlapping strips 9, 10 and 11 are formed with the flanges necessary for clinching of a helical lock-seam, although the strips initially are fed in relatively laterally staggered form as shown in FIG. 5*a*, the fact that the margins of the strips follow different radii of curvature as the flanges are bent causes the marginal edges of the strips to be brought into register, or substantially into register, in a common plane, as the superposed strips are fed towards the clinching rollers of the machine. As will be understood by one skilled in the art, the radii of curvature of the corresponding surfaces provided in the forming rollers 22, 23 and 24 and in the external clinching roller will be matched to the radii of curvature resulting from the required formation of the overlapping strips.

Figure 6:
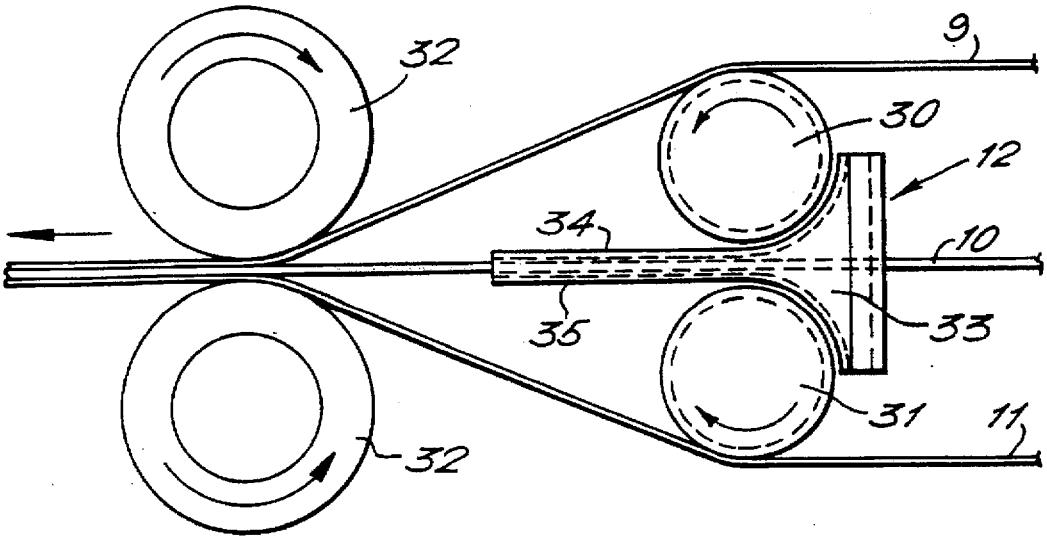
FIG. 6 is a diagramatic side elevation illustrating a guide arrangement for use in feeding three overlapping strips to the machine.

As mentioned above, when three overlapping strips are fed to the machine 1, there is advantageously provided between the nearest supply reel 6 and the machine 1, a guide arrangement 12 for locating the strips in desired symmetrical positions. This arrangement is shown in more detail in FIG. 6, wherein the guide arrangement indicated generally at 12 comprises upper and lower guide rollers 30 and 31 that guide the upper and lower strips 9 and 11 as they pass towards the nip of a further pair of guide rollers 32 located at the commencement of the feed path of the machine. Between the rollers 30 and 31 is mounted a guide member comprising vertical lateral guide plates 33 and upper and lower horizontal guide plates 34, 35, between which the insulating strip 10 is guided. The assembly 12 is mounted in fixed relation to the rollers 32 by suitable means, not shown, arranged laterally of the paths of the strips 9, 10 and 11.

Figure 7A:
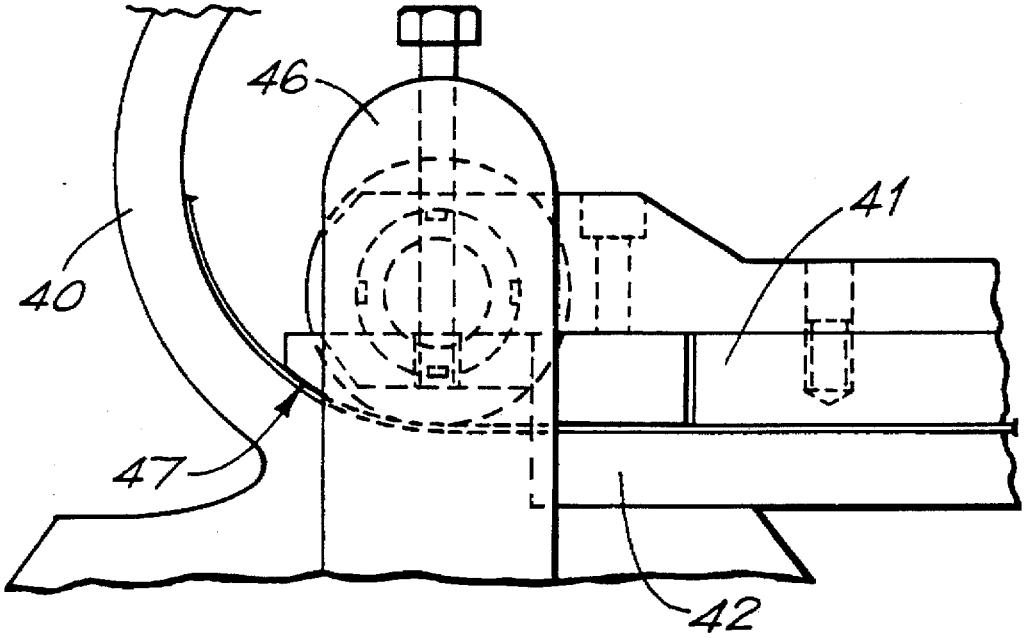
FIG. 7A is a diagramatic side elevation illustrating the provision of an internal guide plate within the helical forming head of the machine.
Figure 7B:
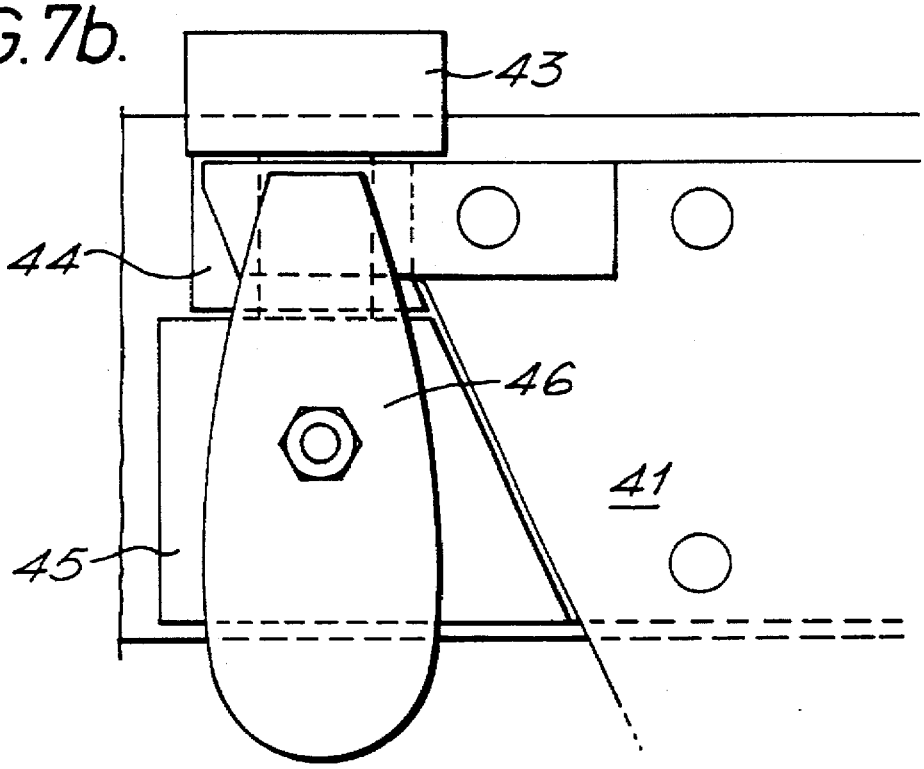
FIG. 7B is a plan view corresponding to FIG. 7A.

Referring to FIGS. 7*a* and 7*b*, there are shown diagramatically the conventional forming head 40 of the machine 1 together with upper and lower guide plates 41 and 42 and an internal support roller 43 that engages the interior of the formed tubing and supports the tubing against the pressure of the external clinching roller. All of these components are provided in the conventionally known machines for the formation of helically wound lock-seam tubing and will be well known to one skilled in the art. In addition, however, there are provided internal guide plates 44 and 45 of suitable synthetic plastics material, such as POM (polyoxymethylene), that are supported respectively from a mounting for the support roller 43 and from a support arm 46 that provides additional bracing for the mounting of the support roller 43. POM resin has the required structural properties whilst having a low coefficient of friction and being relatively easy to form to the required shape. As can be seen more clearly from FIG. 7*a* the guide plates 44 and 45 are shaped to follow the radius of curvature of the forming head 40, as indicated at 47. Thus, as the overlapping metal strips are urged by the drive rollers 20, 21 into engagement with the curved surface of the forming head 40 they are supported by the guide plates 44 and 45 during the initial bending to the radius of curvature of the forming head 40. Thus buckling of the overlapping strips at this point is prevented.

It will be appreciated from the above disclosure that the present invention accordingly provides novel enhancements of a helical lock-seam forming machine that enables a plurality of overlapping strips of metal or other material to be guided and formed into a helical tube in the same manner as a single strip. This arrangement accordingly provides significant advantages over hitherto known proposals for the formation of multi-wall lock-seam tubing, wherein individual handling of separate strips is necessary, and/or it is necessary to modify the conventional lock-seam of the metal tube.

I claim:

1. A machine for forming helical lock-seam tubing, comprising:

means for receiving a plurality of laterally staggered overlapped strips and forming male and female flanges on opposite marginal edges of said strips, said means for receiving and forming including a series of longitudinally adjacent forming rollers;

means for drawing said laterally staggered overlapped strips through said means for receiving and forming, said means for drawing including a pair of drive rollers spaced one above the other downstream of said means for receiving and forming;

means for forming said laterally staggered overlapped strips into a helical configuration while bringing said male and female flanges into interengagement, said means for forming including an external helical forming head located downstream of said means for drawing;

means for clinching said male and female flanges into locking engagement with one another after said male and female flanges have become interengaged with each other and while said laterally staggered overlapped strips maintain their helical configuration, said means for clinching including rollers associated with said external helical forming head;

means for supplying said laterally staggered overlapped strips toward said means for receiving and forming, said means for supplying including longitudinally spaced reels each having a respective one of said strips coiled thereabout and each being located upstream of said means for receiving and forming, such that a first strip supplied from a reel upstream of at least one other reel is brought into a laterally offset contact with a second strip substantially at a point where the first strip becomes tangential to and rests upon the second strip while coiled on said at least one other reel, and then these overlapped strips are supplied towards said means for receiving and forming with said first strip on top of said second strip and laterally offset relative thereto; and means for guiding said laterally staggered overlapped strips to said means for receiving and forming, said means for guiding being located longitudinally between said means for supplying and said means for receiving and forming, and including a pair of guide rollers located one above the other, with each guide roller provided with radially stepped shoulders so that the overlapped metal strips are passed between said guide rollers with lateral edges of each strip contacting a respective one of said shoulders such that said strips are maintained in their laterally staggered overlapping relationship as they are received and formed by said means for receiving and forming, wherein said forming rollers of said means for receiving and forming and said guide rollers of said means for guiding are immediately adjacent each other and form a common train of rollers.

2. The machine according to claim 1, wherein the drive roller located above the other drive roller has a knurled surface.

3. The machine according to claim 1, wherein said means for forming further includes at least one internal shaped counterpressure place located upstream of said external helical forming head, said at least one counterpressure plate including portions shaped to the curvature of the internal surface of the tubing, such that the helically staggered overlapped metal strips are held closely in contact with one another during initial shaping thereof by said external helical forming head.

4. The machine according to claim 1, wherein said means for supplying includes three reels with metal strips coiled thereabout, and said machine further comprises between the downstream most reel and said means for guiding a second guide means for maintaining said strips in spaced relation, such that the central strip is maintained substantially tangential to both guide rollers and the other strips are maintained symmetrically with respect to the central strip.

5. The machine according to claim 1, wherein said second guide means includes a first pair of spaced apart upper and lower guide rollers, a second pair of upper and lower guides rollers located downstream from said first pair of spaced apart upper and lower guide rollers, and a guide arranged between said first pair of rollers, whereby the central strip is passed through said guide, and the other strips are passed over and under said first pair of rollers, respectively, and then all the strips are passed between said second pair of rollers.

6. The machine according to claim 5 wherein said guide includes a pair of upper and lower guide plates and a pair of lateral guide plates defining a guide path.

7. The machine according to claim 6, wherein said central strip is an insulating material and said other strips are metal.

* * * * *